US007281872B2

(12) United States Patent
Studer et al.

(10) Patent No.: US 7,281,872 B2
(45) Date of Patent: Oct. 16, 2007

(54) PRINTER

(75) Inventors: Anthony D. Studer, Albany, OR (US); Antonio S. Cruz-Uribe, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 11/263,456

(22) Filed: Oct. 31, 2005

(65) Prior Publication Data

US 2007/0098474 A1 May 3, 2007

(51) Int. Cl.
*B41J 25/34* (2006.01)
*B41J 3/46* (2006.01)
*B41J 3/28* (2006.01)

(52) U.S. Cl. ..... 400/283; 400/88

(58) Field of Classification Search ..... 400/283, 400/88; *B41J 3/36*
See application file for complete search history.

(56) References Cited

U.S. PATENT DOCUMENTS 4,660,471 A * 4/1987 Wright et al. ..... 101/219
4,947,262 A * 8/1990 Yajima et al. ..... 358/296
4,999,016 A * 3/1991 Suzuki et al. ..... 400/88
5,024,541 A * 6/1991 Tsukada et al. ..... 400/88
5,343,804 A * 9/1994 Karlyn et al. ..... 101/39
5,593,236 A * 1/1997 Bobry ..... 400/88
5,634,730 A * 6/1997 Bobry ..... 400/88
6,338,555 B1 * 1/2002 Hirose ..... 347/109
6,364,458 B2 * 4/2002 Eckard et al. ..... 347/49
6,769,360 B2 * 8/2004 Walling ..... 101/327

FOREIGN PATENT DOCUMENTS

| | | |
|---|---|---|
| JP | 1035026 | 2/1989 |
| JP | 9277614 | 10/1997 |
| JP | 09300639 A | 11/1997 |
| JP | 09300640 | 11/1997 |
| WO | WO 01/07261 | 2/2001 |

* cited by examiner

*Primary Examiner*—Edward Lefkowitz
*Assistant Examiner*—Jonathan Dunlap

(57) ABSTRACT

Various embodiments of a printer including an actuation member are disclosed.

31 Claims, 4 Drawing Sheets

PRINTER

The present application is related to co-pending U.S. patent application Ser. No. 11/208475 filed on Aug. 19, 2005 by Anthony D. Studer, Kevin D. Almen and Kevin E. Swier, and entitled PRINTER, the full disclosure of which is hereby incorporated by reference.

BACKGROUND

Handheld printers are sometimes used to print labels and other indicia upon objects. Such handheld printers may utilize complex and expensive drive mechanisms or may lack a sufficiently compact size for ease of use and storage.

DETAILED DESCRIPTION OF THE EXAMPLE EMBODIMENTS

Figure 1:
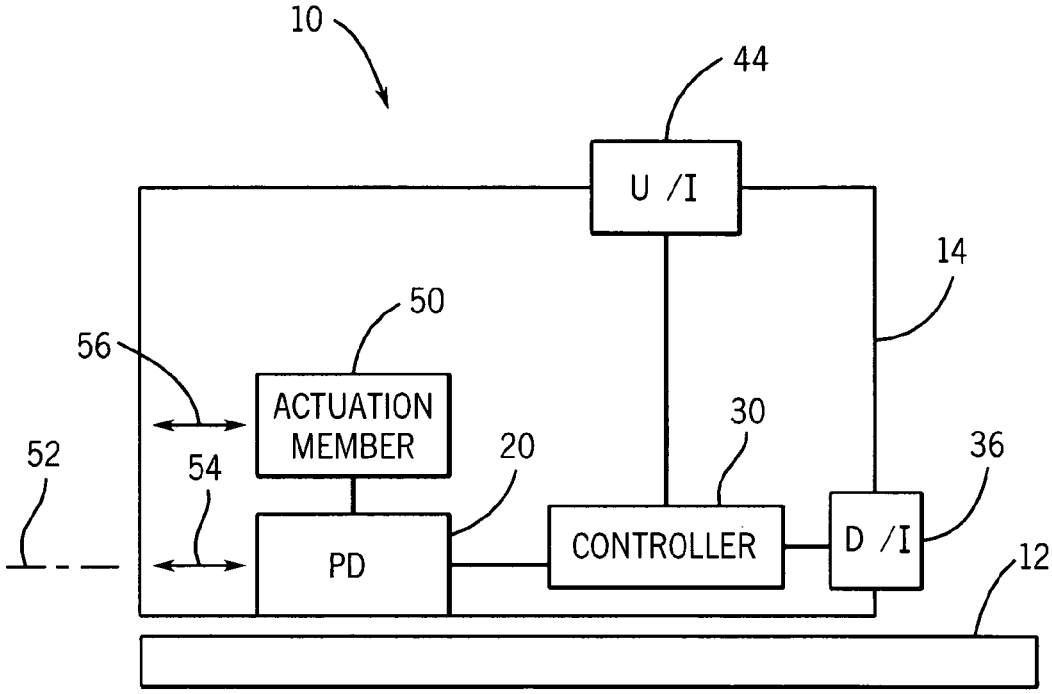
FIG. 1 is a schematic illustration of an embodiment of a printer according to one example embodiment.

FIG. 1 schematically illustrates printer 10 which is configured to print one or more printing materials upon a medium 12. Printer 10 generally includes housing 14, print device 20, controller 30, data interface 36, user interface 44 and manual actuation member 50. Housing 14 comprises one or more structures configured to support, house, and/or contain the remaining components of printer 10. In one embodiment, housing 14 is sized and shaped so as to be held and grasped by a hand of a user. In other embodiments, housing 14 may have other configurations.

Print device 20 is a device configured to interact with media 12 so as to form an image or indicia upon medium 12. In one embodiment, print device 20 includes an inkjet printhead configured to deposit ink upon medium 12. In other embodiments, print device 20 may comprise other devices configured to print or deposit printing material upon medium 12 or so as to interact with medium 12 in other fashions to form images upon medium 12.

Print device 20 is movably coupled to housing 14 so as to be movable relative to housing 14 and relative to medium 12. In one embodiment, print device 20 is movably coupled to housing 14 so as to be linearly movable in the direction along axis 52 indicated by arrows 54. For purposes of this disclosure, the term "coupled" shall mean the joining of two members directly or indirectly to one another. Such joining may be stationary in nature or movable in nature. Such joining may be achieved with the two members or the two members and any additional intermediate members being integrally formed as a single unitary body with one another or with the two members or the two members and any additional intermediate member being attached to one another. Such joining may be permanent in nature or alternatively may be removable or releasable in nature.

In one embodiment, print device 20 may be movably supported along a rod or other guide structure coupled to housing 14. In yet another embodiment, print device 20 may include one of a projection and a groove while housing 14 includes the other of a projection and a groove, wherein the projection is received within the groove to facilitate sliding of print device 20 relative to housing 14. In one embodiment, print device 20 may include an ink cartridge and carriage structure connected to the cartridge and movably connected to housing 14. In yet another embodiment, print device 20 may include an ink cartridge that is directly movably connected to housing 14.

Controller 30 comprises a processing unit configured to generate control signals for directing printing by print device 20. For purposes of this disclosure the term "processing unit" shall mean a presently or future developed processing unit that executes sequences of instructions contained in a memory. Execution of the sequences of instructions causes the processing unit to perform steps such as generating control signals. The instructions may be loaded in a random access memory (RAM) for execution by the processing unit from a read only memory (ROM), a mass storage device, or some other persistent storage. In other embodiments, hard wired circuitry may be used in place of or in combination with software instructions to implement the functions described. Controller 30 is not limited to any specific. combination of hardware circuitry and software, nor to any particular source for the instructions executed by the processing unit.

In one embodiment, controller 30 receives data via external data interface 36 supported by housing 14 and electrically connected to controller 30. In one embodiment, interface 36 is configured to be electrically connected to an external data source such as an external computer, camera and the like via a cable or wire. In yet another embodiment, interface 36 is configured to communicate with external data sources such as computers, cameras and the like in a wireless fashion. In yet other embodiments, interface 36 may be omitted where controller 30 or printer 10 has a memory which includes one or more images that may be printed by print device 20.

In one embodiment, controller 30 may additionally receive controls or direction from user interface 44. User interface 44 comprises a device configured to receive input or instructions from a user of printer 10 and to transmit such data, commands or instructions to controller 30. For example, in one embodiment, user interface 44 may be configured to receive power up commands from a user for turning printer 10 on and off. In other embodiments, user interface 44 may additionally be configured to enable a user of printer 10 to initiate a printing operation. In yet another embodiment, user interface 44 may be configured to permit a user to choose from multiple potential images stored in a memory associated with controller 30 or to change or alter such images prior to printing by printer 10. In other embodiments, user interface 44 may be configured to allow user to input other commands or instructions to printer 10. Examples of portions of user interface 44 that are configured to allow entry of commands or instructions include buttons, slide bars, switches, dials and the like.

In particular embodiments, user interface 44 may also or alternatively be configured to communicate information to a user of printer 10. For example, user interface 44 may be configured to communicate various printing options available from which a user may choose or may be configured to provide a user with a status of printing. In such embodiments, user interface 44 may additionally or alternatively include a display or screen, one or more light emitting devices such as light emitting diodes or one or more audio generating devices for creating sounds communicating information. In still other embodiments, user interface 44 may be omitted.

Manual actuation member 50 comprises one or more structures operably coupled to print device 20 and configured to be manually engaged by a person. For purposes of this disclosure, the term "manual" shall mean involving or using work supplied by a person's hands rather than work derived from a machine power source. Manual actuation member 50 receives force from a person's hand or the like, wherein the force is transmitted to print device 20 to move print device 20. In the particular embodiment illustrated, manual actuation 50 is movable along axis 52 in one of the directions indicated by arrows 54 in response to displacement of actuation member 50 along axis 52 in one of the directions indicated by arrow 56. In one embodiment, manual actuation member 50 may constitute a flap, tab or other projection connected to print device 20 along a portion of housing 14. In one embodiment, member 50 may extend along a longer side of housing 14. In another embodiment, member 50 may be located on an end or shorter side of housing 14. In one embodiment, member 50 may be configured to be pushed or pulled in both directions. In another embodiment, member 50 may be configured to be pushed or pulled in a first direction and resiliently returned under the force of a spring or other bias.

Overall, printer 10 offers a relatively low cost, compact and adaptable hand held printing device. Because printer 10 employs actuation member 50 which utilizes manually applied force from a user to move print device 20, printer 10 may omit or reduce the components for generating force so as to move print device 20. Because manual actuation member 50 is configured to displace print device 20 along axis 52 in response to displacement of actuation member along the same axis 52, printer 10 may be more compact, enabling printer 10 to be more easily held and positioned against medium 12. In particular embodiments, printer 10 may additionally be configured to print one of many potential images as stored by printer 10, as input through data interface 36 or as selected through user interface 44.

Figure 2:
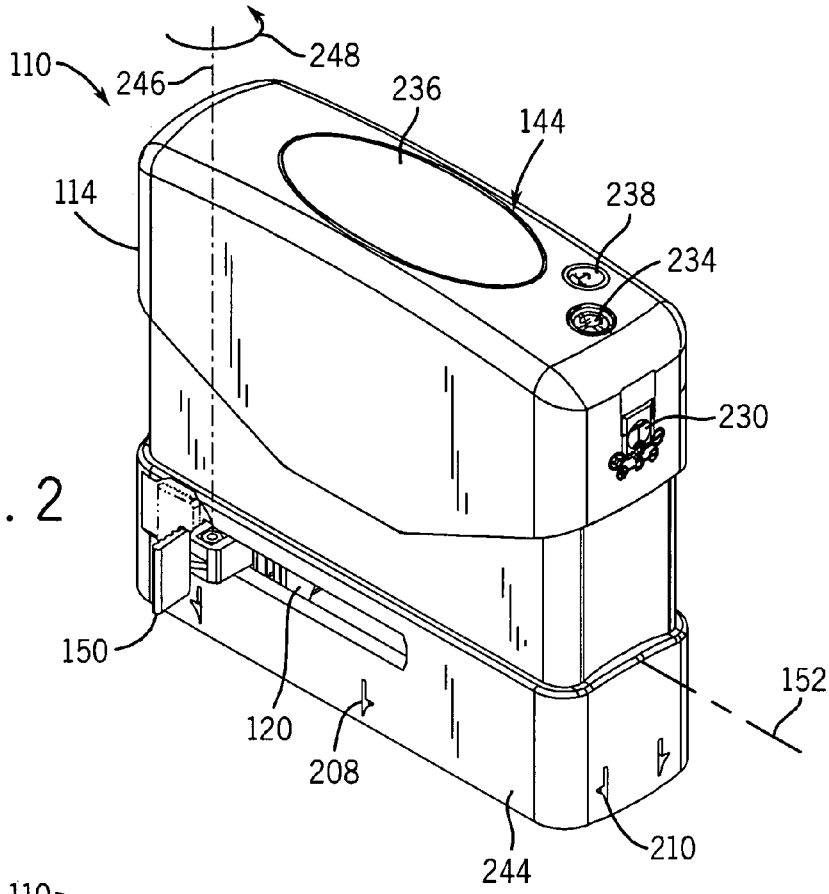
FIG. 2 is a perspective view of another embodiment of the printer of FIG. 1 illustrating a manual actuation member in a first position according to an example embodiment.
Figure 3:
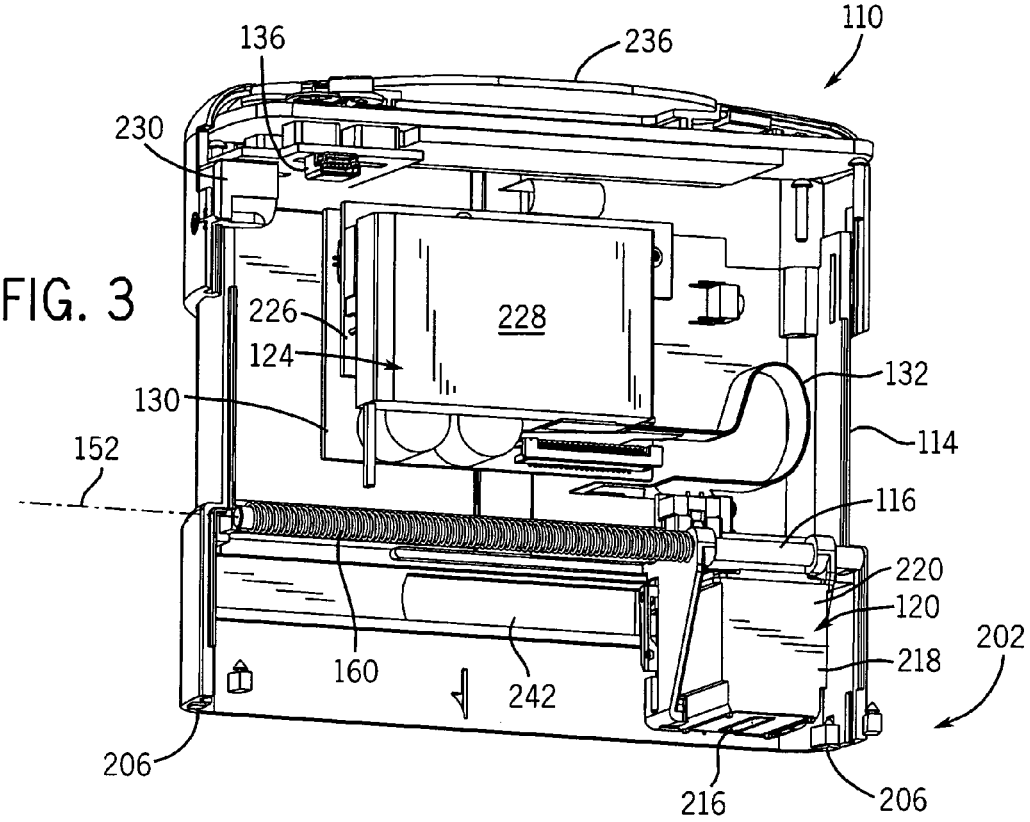
FIG. 3 is a sectional view of the printer of FIG. 2 according to an example embodiment.
Figure 4:
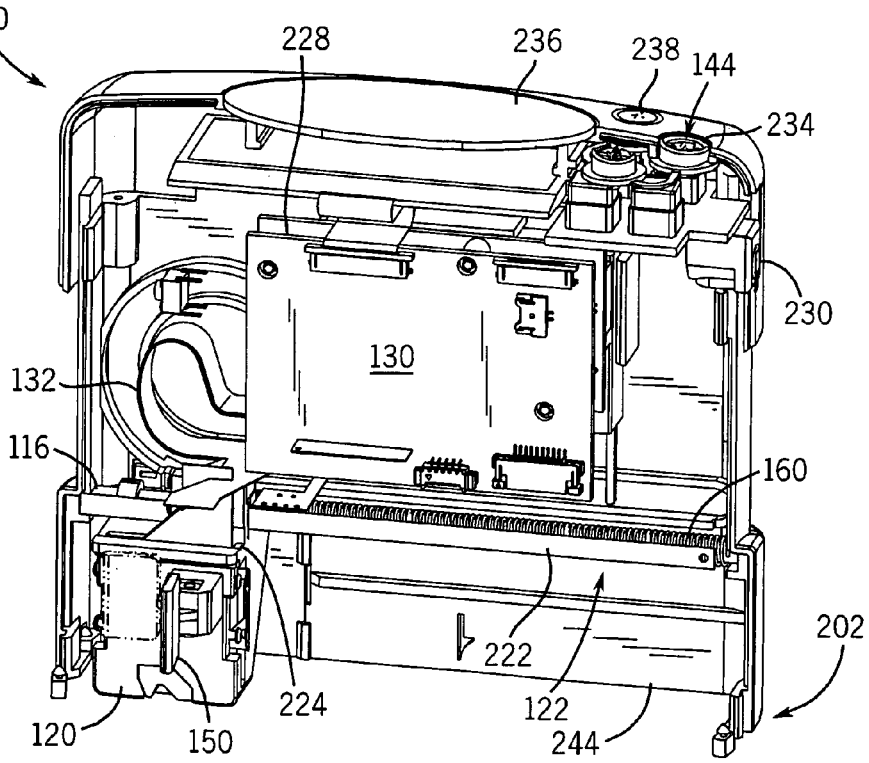
FIG. 4 is a sectional view of the printer of FIG. 2 according to an example embodiment.

FIGS. 2-5 illustrate printer 110, one example of printer 10. As shown by FIGS. 3 and 4, printer 110 generally includes housing 114, guide 116, print device 120, position sensor 122, power source 124, controller 130, interconnect 132, data interface 136 (shown in FIG. 3), user interface 144, manual actuation member 150, and return bias 160. Housing 114 is a structure supporting and partially containing the remaining components of printer 110. In the particular example illustrated, housing 114 has a lower end 202 configured to be positioned against a medium such as medium 12 shown in FIG. 1. Lower end 202 includes feet 206 (shown in FIG. 3) and print area indicators 208, 210 (shown in FIG. 2). Feet 206 constitute elastomeric members configured to be positioned against a medium to facilitate proper spacing of print device 120 from an underlying medium. Print area indicators 208 are indicia such as notches, grooves, projections, marks, clear areas, printing and the like configured to indicate to a user of printer 110 a length dimension along which printing can be formed by printer 110.

Print area indicators 210 are similar to print area indicators 208 except that print area indicators 210 indicate a width dimension along which printing may be performed by printer 110. In other embodiments, other indicia or structures may be used to indicate to a user the area of the underlying medium that may be printed upon by printer 110. In still other embodiments, feet 206 and indicators 208, 210 may be omitted.

Guide 116 is a mechanism configured to guide or direct movement of print device 120 relative to housing 114 and relative to an underlying medium. In the particular example illustrated, guide 116 is configured to guide linear movement of print device 120 along an axis 152 that is substantially parallel to a face of print device 120 and/or a plane of a face of a medium to be printed upon by printer 110. In the particular example illustrated, guide 116 comprises an elongate support rod slidably supporting print device 120 for movement along axis 52. Guide 116 has opposite ends affixed to housing 114. In other embodiments, guide 116 may have other configurations. For example, in another embodiment, guide 16 may include one of a projection and a groove coupled to housing 114 and the other of a projection and a groove coupled to print device 120, wherein the projection is received within the groove and guides linear movement of print device 120 along axis 152.

Print device 120 comprises a device configured to print indicia, pattern, image and the like upon a medium. In one embodiment, print device 120 comprises a device configured to deposit a printing material or other material upon a medium. In another embodiment, print device 120 comprises a device configured to otherwise interact with a medium such that a pattern, image and the like is formed upon a medium. For example, in another embodiment, print device 120 may be alternatively configured to selectively apply heat or pressure to a medium, wherein the medium is configured such that the application of heat or pressure results in an image, pattern or indicia being formed on or in the medium. In the particular example illustrated, print device 120 includes an inkjet printhead 216 (shown in FIG. 3) configured to deposit ink or other fluid material upon a medium. In the particular example illustrated, print device 120 additionally includes an ink supply 218, wherein printhead 216 and supply 218 form a cartridge 220 removably mounted to guide 116. In yet another embodiment, printhead 216 or cartridge 220 may be fixedly or permanently coupled to guide 116 as part of printer 110.

Position sensor 122 comprises a device configured to sense the positioning of print device 120 relative to housing 114 and an underlying medium. In the particular embodiment illustrated, position sensor 122 includes an encoder strip 222 and reader 224. Encoder strip 222 comprises a strip of readable material coupled to housing 114 along guide 116. Reader 224 is coupled to print device 120 so as to move with print device 120 along axis 1152 and so as to read or sense the position identifying indicia provided along strip 222. In one embodiment, strip 222 and reader 224 cooperate in an optical manner to sense the positioning of print device 120 along axis 152. In other embodiments, strip 222 and reader 224 may cooperate in other manners to sense the positioning of print device 120. For example, in another embodiment, strip 222 and reader 224 may alternatively cooperate in a magnetic manner to indicate positioning print device 120. In still other embodiments, position sensor 122 may constitute other sensing devices or arrangements. The detected positioning of print device 120 by sensor 122 is transmitted to controller 130 to assist controller 130 in controlling print device 120.

Power source 124 comprises a source of power for controller 130 and potentially print device 120. In the particular example illustrated, power source 124 includes power supply board 226, internal power supply 228 and external power interface 230. Power supply board 226 comprises a circuit board configured to route and selectively transmit power from supply 228 and/or interface 230 to controller 130 and print device 120. Internal power supply 228 comprises a power storage unit contained within printer 110 for supplying and storing power. In one embodiment, internal power supply 228 comprises a lithium-ion battery. In other embodiments, internal power supply 228 may comprise other power storage structures.

External power interface 230 comprises an interface configured to facilitate the connection of printer 110 to an external source of power, such as a DC power transformer. External power interface 230 enables printer 110 to be operated using power transmitted directly from an external power source or enables internal power supply 228 to be charged. In other embodiments, printer 110 may alternatively omit either power supply 228 or an external power interface 230.

Controller 130 comprises a processing unit configured to generate control signals for directing the printing operations by print device 120. In the particular example illustrated, controller 130 generates such control signals based upon the sensed positioning of print device 120 as indicated by signals from position sensor 122 and based further upon input received from user interface 144. In the particular embodiment illustrated, controller 130 further generates control signals based upon data received from data interface 136 (shown in FIG. 2). In other embodiments, controller 130 may generate such control signals based upon other factors. For example, in one embodiment, controller 130 may alternatively generate control signals based upon a sensed position of manual actuation member 150 (shown in FIG. 2) in lieu of a sensed positioning of print device 120.

Interconnect 132 comprises one or more structures configured to transmit control signals from controller 130 to print device 120. In the particular embodiment illustrated, interconnect 132 is a flexible electrical circuit interconnecting controller 130 and print device 120. In other embodiments, interconnect 132 may comprise other structures or may be omitted wherein control signals from controller 130 are communicated to print device 120 in another fashion such as through wireless communications.

Data interface 136 (shown in FIG. 3) comprises an interface device configured to facilitate transmission or input of image or printing data to printer 110 and to controller 130. In the particular embodiment illustrated, interface 136 comprises a Universal Serial Bus (USB) port. In other embodiments, data interface 136 may comprise other structures facilitating input of data to printer 110. For example, in one embodiment, data interface 136 may include a wireless transmitter and/or receiver configured to communicate with an external source of printing data wirelessly. In still other embodiments, interface 136 may be omitted, wherein image or printing data is stored in a memory permanently associated with controller 130 or wherein the image data is stored on a computer readable memory that is portable and which may be inserted or removed from printer 110.

User interface 144 comprises one or more devices configured to facilitate the input of instructions or data to printer 110 by an operator or user. Interface 144 may additionally provide information to the user of printer 110. In the particular example illustrated, user interface 144 includes power switch 234, display 236 and scroll control 238. Power switch 234 actuates the supply of power from power source 124 to controller 130 and further actuates controller 130 between an on state and an off state. Although power switch 234 is illustrated as a push button which may be used to toggle printer 110 between on and off states, power switch 204 may comprise other input mechanisms.

Display 236 is configured to display information to a user. In one embodiment, display 236 is configured to provide a user with a visual representation of an image, indicia, text and the like that may be printed. In the particular example illustrated, display 236 is further configured to present instructions and/or options to a user for selection. For example, in one embodiment, the memory of controller 130 may include multiple images (i.e., text, pictures and the like) from which a user may choose to be printed by printer 110. Control 238 comprises push buttons enabling a user to scroll through such various printing options so as to select an image to be printed by printer 110. In other embodiments, display 236 and control 238 may be omitted or may have other configurations. In one embodiment, in lieu of interface 144 including a display 206, interface 144 may include various light emitting diodes or the like which are selectively illuminated to communicate information or options to a user.

Manual actuation member 150 (shown in FIGS. 2 and 4) comprises a structure directly attached to print device 120 and configured to be manually moved by a user so as to receive force which is transmitted to print device 20 to move print device 20 along axis 152. In the particular embodiment illustrated, manual actuation member 150 comprises a tab or flap attached to print device 120 through an elongate slot 242 along a longer side 244 of housing 114.

As shown by FIG. 2, in the particular embodiment illustrated, manual actuation member 150 is further pivotally connected to print device 120 so as to be pivotable between an extended actuation position (shown in solid) in which member 150 may be grasped and moved along side 244 and a retracted position (shown in phantom) in which member 150 extends parallel to and along side 244, facilitating compact storage and shipping of printer 110 while reducing the likelihood of member 150 being caught up an external object when printer 110 is not being used. In such an embodiment, pivotal movement of manual actuation member 150 about axis 246 is limited such that member 150 does not pivot further about axis 246 in the direction indicated by arrow 248 (shown in FIG. 2). In other embodiments, manual actuation member 150 may not be pivotable, may have other configurations, may be connected to print device 120 in other fashions, and may extend through or along housing 114 at other locations and in other directions.

Return bias 160 (shown in FIGS. 3 and 4) comprises one or more structures configured to resiliently bias print device 120 and/or manual actuation member 150 to a home position along axis 152. In the particular embodiment illustrated, return bias 160 comprises an elongate compression spring extending along and about support 116 and along axis 152. In other embodiments, return bias 160 may alternatively constitute other types of springs or other structures configured to resiliently bias print device 120 to a home position along axis 152. For example, in another embodiment, return bias 160 may alternatively constitute a tension spring having a first end connected to one or both of print device 120 and manual actuation member 150 and a second opposite end coupled to housing 114, wherein movement of print device 120 stretches the tension spring. In still other embodiments, return bias 160 may be omitted.

Figure 5:
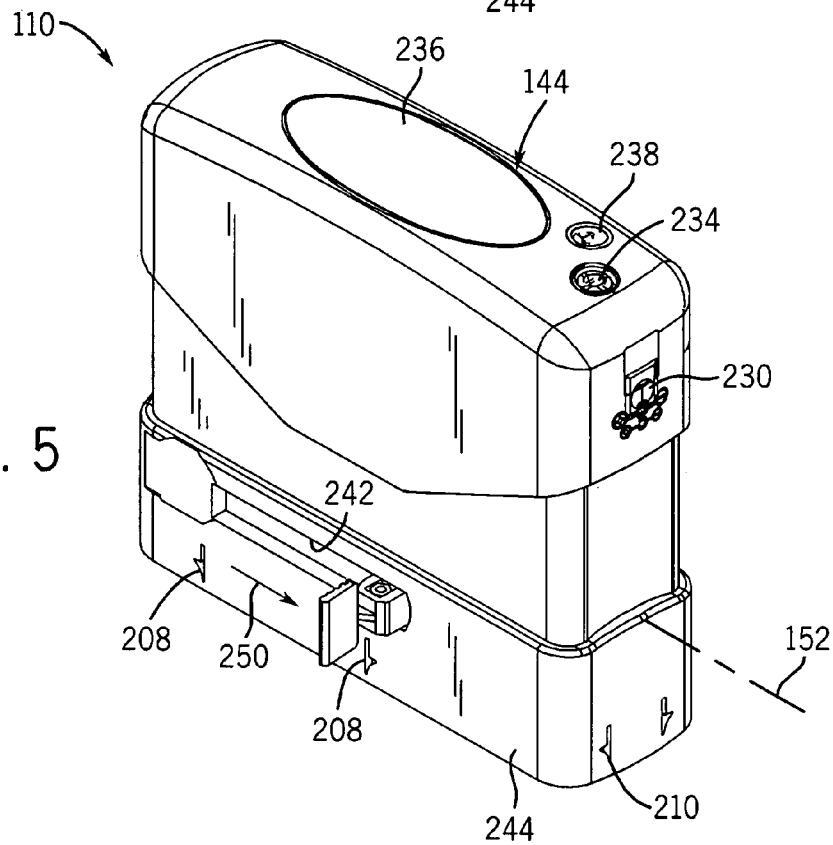
FIG. 5 is a perspective view of the printer of FIG. 2 illustrating the manual actuation member in a second position according to an example embodiment.

FIGS. 2 and 5 illustrate one example mode of operation for printer 110. FIG. 2 illustrates printer 110 prior to printing. In particular, FIG. 2 illustrates manual actuation member 150 and print device 120 resiliently biased to a home position along axis 152 by return bias 160 (shown in FIGS. 3 and 4). Prior to printing, a person may select an image to be printed from the options communicated by display 236. In the particular embodiment illustrated, the person may scroll through the various options using button 238. Once a desired image (graphics or text) is presented on display 236 and printer 110 is positioned over a medium to be printed upon, the person may pivot manual actuation member 150 to the extended position (shown in solid). Thereafter, the person may grasp manual actuation member 150 and move manual actuation member 150 in the direction indicated by arrow 250 to the position shown in FIG. 5. As the person applies force to manual actuation member 150, print device 120 is moved against the bias force applied by return bias 160. During movement of print device 120 along axis 152 (shown in FIG. 3), position sensor 122 detects such movement of print device 120 and transmits the repositioning of print device 120 to controller 130. In response to such signals, controller 130 generates and transmits control signals via interconnect 132 to print device 120 causing print device 120 to eject ink or other printing material through printhead 216 upon the medium (not shown.) based upon the positioning of print device 120. Once the desired image has been printed upon the medium, the person may return manual actuation member 150 to the home position shown in FIG. 2 or may let go of manual actuation member 150, wherein return bias 160 returns manual actuation member 150 and print device 120 to the home position shown in FIG. 2. In embodiments where return bias 160 is omitted, the person may manually return manual actuation member 150 and print device 120 to the home position shown in FIG. 2. During return movement of print device 120, controller 130 may generate control signals further directing print device 120 to eject and deposit ink through printhead 216 during the return pass. In other embodiments, ejection of ink by print device 120 may be cessated during return movement of print device 120 to the home position.

Figure 6:
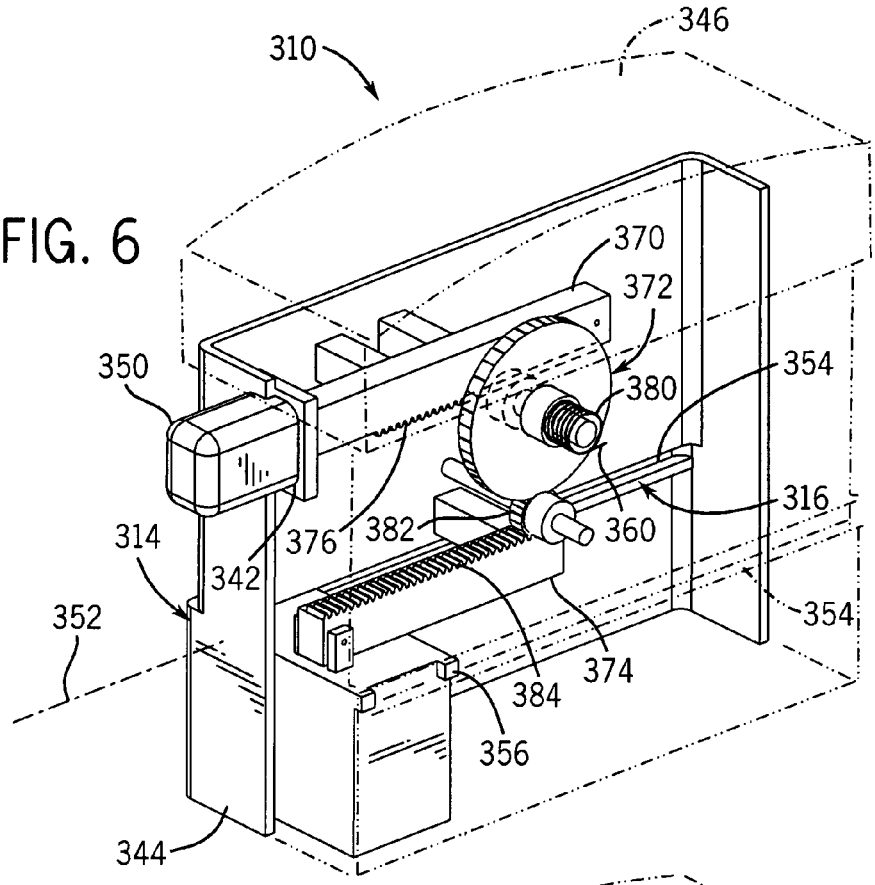
FIG. 6 is a perspective view of another embodiment of the printer of FIG. 1 with portions shown in phantom and illustrating a manual actuation member in a first position according to an example embodiment.
Figure 7:
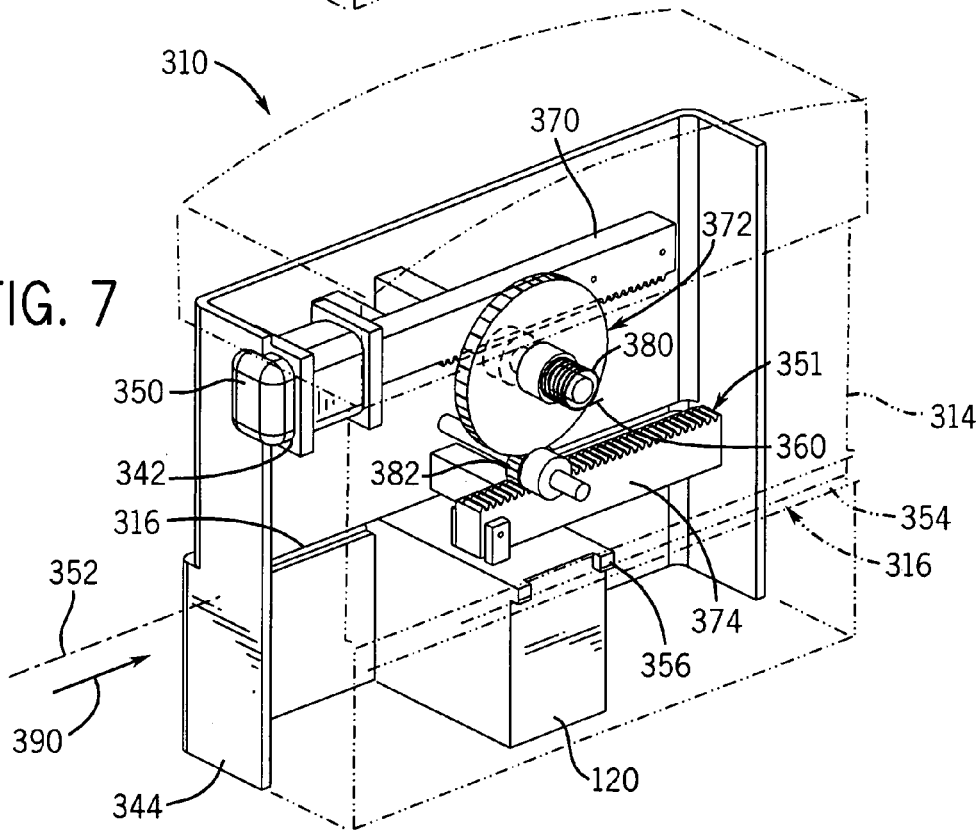
FIG. 7 is a perspective view of the printer of FIG. 6 with portions shown in phantom and illustrating the manual actuation member in a second position according to an example embodiment.

FIGS. 6 and 7 illustrate printer 310, another embodiment of printer 10 shown in FIG. 1. Printer 310 is similar to printer 110 except that printer 310 includes housing 314, guides 316, manual actuation member 350, transmission 351 and return bias 360 in lieu of guide 160, manual actuation member 150 and return bias 160. Those remaining elements of printer 210 are also part of printer 310, but are omitted from FIGS. 6 and 7 for ease of illustration. Housing 314 is similar to housing 114 except that housing 314 includes an opening 342 in lieu of slot 242, through which manual actuation member 350 extends. Opening 342 is located on a smaller side or end 344 of housing 314. Like housing 114, housing 314 is configured and sized to be hand held by a person. In the particular embodiment illustrated, housing 314 is configured such that its top 346 may be positioned within a person's palm and such that manual actuation member 350 may be engaged by a person's index finger. In other embodiments, housing 314 may have other configurations. For example, in another embodiment, housing 314 may alternatively be configured to be held in a user's palm while manual actuation member 350 is engaged by a person's thumb.

Guides 316 comprises structures coupled to housing 314 and configured to guide movement of print device 120 along axis 352. In the particular example illustrated, guides 316 include elongate channels 354 and corresponding projections or tongues 356. Grooves or channels 354 are coupled to housing 314 and slidably receive tongues 356 which are coupled to print device 120. In other embodiments, guides 316 may have other configurations and locations. For example, in another embodiment, guide 316 may alternatively constitute an elongate rod or shaft (similar to guide 116) along which print device 120 moves.

Manual actuation member 350 comprises one or more structures movably coupled to housing 314 and configured to be manually engaged by a person's hand so as to receive force which is transmitted to print device 120 by transmission 351. In the particular embodiment illustrated, manual actuation member 350 comprises an elongate push button slidably projecting through housing 314. In the particular example illustrated, manual actuation member 350 slidably extends through opening 342 on end 344 of housing 314. Manual actuation member 350 is operably connected to transmission 351. In other embodiments, manual actuation member 350 may have other sizes, shapes and locations.

Manual actuation member 350 is configured to move and receive force in a direction along axis 352, the same axis along which print device 120 is movable. As a result, actuation of member 350 to move print device 120 is more intuitive to a person using printer 310.

Transmission 351 comprises one or more structures configured to transmit manually applied force from manual actuation member 150 to print device 120 so as to move print device 20 along axis 352. As shown by FIGS. 6 and 7, transmission 354 includes linear drive 370, rotary drive 372 and linear drive 374. Linear drive 370 comprises one or more devices configured to transmit manual force applied to manual actuation member 350 to rotary drive 372. In the particular embodiment illustrated, linear drive 370 comprises a rack gear having an end fixedly coupled to manual actuation member 350 such that movement of member 350 along axis 352 also moves linear drive 370 along axis 352. Linear drive 370 includes teeth 376 in meshing engagement with rotary drive 372.

Rotary drive 372 comprises one or more structures rotatably supported by housing 314 and configured to be rotatably driven by linear drive 370. Rotary drive 372 is further configured to transmit force to linear drive 374 about being rotated such that print device 120 is moved or scanned along axis 352.

In the particular example illustrated, rotary drive 372 includes pinion gears 380 and 382. Pinion gear 380 is rotatably supported by housing 314 in meshing engagement with teeth 376 of linear drive 370. Pinion gear 382 is rotatably supported by housing 314 in meshing engagement with pinion gear 380 and teeth 384 of linear drive 374. In the particular example illustrated, pinion gear 380 has a diameter larger than a diameter of pinion gear 382 such that rotary drive 372 provides distance multiplication. In other words, movement of manual actuation member 350 and linear drive 370 a first distance along axis 352 results in movement of linear drive 374 and print device 20 a second greater distance along axis 352. As a result, a length of manual actuation member 350 and an extent to which member 350 projects from housing 314 may be reduced. In addition, the extent or distance to which a person must depress manual actuation member 350 to sufficiently move print device 120 along axis 352 may also be reduced. In other embodiments, gears 380 and 382 may alternatively have similar diameters.

Although gears 380 and 382 are illustrated as being in meshing engagement so as to transmit force between one another. In other embodiments, force may be transmitted from gear 380 to gear 382 in other manners. For example, in one embodiment, force between gears 380 and 382 may alternatively be transmitted by an intervening belt and pulley arrangement, by an intervening chain and sprocket arrangement or by an additional gear train disposed between gears 380 and 382.

Linear drive 374 comprises one or more members or structures configured to transmit and convert rotary motion or torque received from rotary drive 372 to print device 120 so as to linearly move print device 120 along axis 352. In the particular example illustrated, linear drive 374 comprises a rack gear having teeth 384 in meshing engagement with pinion gear 382. Linear drive 374 is fixedly coupled to print device 120 such that movement of linear drive 374 along axis 352 also results in movement of print device 120 along axis 352.

Return bias 360 comprises one or more structures configured to resiliently bias print device 120 and manual actuation member 350 to a home position shown in FIG. 6. In the particular example illustrated, return bias 360 comprises a torsion spring having a first end fixedly coupled to pinion gear 380 and a second end fixedly coupled to housing 314. During depressment of member 350 and rotation of pinion gear 380 in the clockwise direction as seen in FIG. 6 to move print device 120 in the direction indicated by arrow 390 along axis 352, return bias 360 is wound. Upon release of manual actuation member 350, return bias 360 unwinds to return print device 120 and member 350 to their home position shown in FIG. 6.

Although return bias 360 is illustrated as a torsion spring coupled to pinion gear 380, return bias 360 may constitute other mechanisms at other locations configured to resiliently bias member 350 and print device 120 to their home positions. For example, in other embodiments, return bias 360 may alternatively constitute a torsion spring having a first end connected to pinion gear 382 and a second end connected to housing 314. In still other embodiments, return bias 360 may constitute a compression spring, a tension spring or a leaf spring appropriately configured to resiliently bias print device 120 and member 350 to the home position shown in FIG. 6. In still other embodiments, return bias 360 may be omitted.

In operation, once an individual person has appropriately positioned printer 310 relative to a medium to be printed upon, manual actuation member 350 may be depressed and moved along axis 352 in the direction indicated by arrow 390 in FIG. 7. As noted above, in particular embodiments, this may be achieved by a person using his or her index finger or thumb. As a result, linear drive 370 is also moved along axis 352 to rotatably drive pinion gear 380. Rotation of pinion gear 380 rotatably drives pinion gear 382. During such rotation of pinion gear 380, return bias 360 is wound. Rotation of pinion gear 382 linearly moves linear drive 374 and print device 120 along axis 352 in the direction indicated by arrow 390. During such movement, guides 316 guide movement of print device 120. As discussed above with respect to printer 120, the positioning of print device 120 is sensed by position sensor 122 and communicated to controller 130 (both of which are shown in FIG. 3). As a result, controller 130 generates control signals directing print device 120 to eject ink through its printhead 216 (shown in FIG. 3) onto the medium. Once manual actuation member 350 has been fully depressed, the user may release manual actuation member 350, whereby return bias 360 unwinds to return manual actuation member 350 and print device 120 to the home position shown in FIG. 6. During such return movement, printing by printer device may be cessated by controller 130 or printing may continue.

Although the present invention has been described with reference to example embodiments, workers skilled in the art will recognize that changes may be made in form and detail without departing from the spirit and scope of the invention. For example, although different example embodiments may have been described as including one or more features providing one or more benefits, it is contemplated that the described features may be interchanged with one another or alternatively be combined with one another in the described example embodiments or in other alternative embodiments. Because the technology of the present invention is relatively complex, not all changes in the technology are foreseeable. The present invention described with reference to the example embodiments and set forth in the following claims is manifestly intended to be as broad as possible. For example, unless specifically otherwise noted, the claims reciting a single particular element also encompass a plurality of such particular elements.

What is claimed is:

1. A printer comprising:

a print device including an inkjet printhead; and a manual actuation member operably coupled to the print device to linearly translate the inkjet printhead along a first axis in response to displacement of the actuation member along the first axis.

2. The printer of claim 1, wherein the actuation member is operably coupled to the print device such that displacement of the actuation member in a first direction along the first axis linearly translates the print device in the first direction along the first axis.

3. The printer of claim 1, wherein the actuation member is directly connected to the print device.

4. The printer of claim 1, wherein the print device is resiliently biased towards a first position along the first axis.

5. The printer of claim 1 further comprising a housing having a wall proximate the print device, wherein the print device is on a first side of the wall and wherein the actuation member extends through and projects from a second opposite side of the wall.

6. The printer of claim 1, wherein the actuation member includes a handle extending non-parallel to the first axis.

7. The printer of claim 6, wherein the handle is configured to pivot between a first extended position in which the handle extends non-parallel to the first axis and a second retracted position substantially perpendicular to the first position.

8. The printer of claim 7, wherein the handle is configured to pivot about a second axis perpendicular to the first axis.

9. The print device of claim 1 further comprising a sensor configured to sense the positioning of the print device along the first axis.

10. The printer of claim 9, wherein the sensor includes:

an encoder strip extending along the first axis; and a reader coupled to the print device.

11. The printer of claim 1 further comprising a housing supporting the print device and the actuation member, the housing including print area indicators configured to indicate a print area dimension, wherein the print area dimension is less than a corresponding dimension of the housing.

12. The printer of claim 1 further comprising a controller configured to generate control signals, wherein the print device is configured to print in response to the control signals.

13. The printer of claim 1 further comprising a display configured to provide a visual representation of an image to be printed.

14. The printer of claim 1 further comprising a memory configured to store images for print by the print device.

15. The printer of claim 1 further comprising a housing about the print device, the housing having a top and a side, wherein the actuation member extends through, projects from and moves along the side.

16. The printer of claim 1 further comprising a housing supporting the print device and the actuation member, wherein the housing is configured to be hand-held.

17. The printer of claim 1 further comprising:

a first rack gear connected to the actuation member so as to move with the actuation member;

a second rack gear connected to the print device so as to move with the print device; and a pinion gear operably coupled between the first rack gear and the second rack gear.

18. The printer of claim 1 further comprising:

a housing about the print device or at least partially about the print, wherein the manual actuation member is accessible outside the housing.

19. The printer of claim 18 wherein the manual actuation member extends through the housing.

20. A method comprising:

manually moving an actuation member coupled to a print device along an axis to linearly translate the print device along the axis in a plane substantially parallel to a surface; and printing on the surface along the axis with the print device.

21. The method of claim 20, wherein the printing includes ejecting ink.

22. The method of claim 20 further comprising resiliently biasing the print device towards a first position with a bias force, wherein the moving of the actuation member moves the print device from the first position against the bias force.

23. The method of claim 20, wherein the print device is received within a housing and wherein the actuation member is moved along an exterior of the housing.

24. The method of claim 20 further comprising storing images in a memory associated with the print device.

25. The method of claim 24 further comprising displaying the stored images.

26. The method of claim 20 further comprising generating control signals, wherein the printing is in response to the control signals.

27. The method of claim 20 further comprising sensing a position of the print device along the axis.

28. A printer comprising:

a print device;

a manual actuation member operably coupled to the print device to linearly translate the print device along a first axis in response to displacement of the actuation member along the first axis;

a first rack gear connected to the actuation member so as to move with the actuation member;

a second rack gear connected to the print device so as to move with the print device; and a pinion gear operably coupled between the first rack gear and the second rack gear.

29. A printer comprising:

a print device;

a manual actuation member operably coupled to the print device to displace the print device along a first axis in response to displacement of the actuation member along the first axis; and a sensor configured to sense a plurality of positions of the print device along the first axis, wherein the sensor includes:

an encoder strip extending along the first axis; and a reader coupled to the print device.

30. The printer of claim 1, wherein the manual actuation member is operably coupled to the print device to linearly translate the inkjet print head along the first axis in a plane substantially parallel to a surface being printed upon.

31. The method of claim 20 wherein the movement of the print device comprises linear translation along the axis.

* * * * *